US010917729B2

(12) United States Patent
Khing et al.

(10) Patent No.: US 10,917,729 B2
(45) Date of Patent: Feb. 9, 2021

(54) NEUTRALIZING THE EFFECT OF A MEDICAL DEVICE LOCATION

(71) Applicants: Phyu Phyu Khing, Sydney (AU); Brett Swanson, Sydney (AU)

(72) Inventors: Phyu Phyu Khing, Sydney (AU); Brett Swanson, Sydney (AU)

(73) Assignee: COCHLEAR LIMITED, Macquarie University (AU)

( * ) Notice: Subject to any disclaimer, the term of this patent is extended or adjusted under 35 U.S.C. 154(b) by 0 days.

(21) Appl. No.: 16/458,545

(22) Filed: Jul. 1, 2019

(65) Prior Publication Data

US 2019/0387328 A1 Dec. 19, 2019

Related U.S. Application Data

(63) Continuation of application No. 15/162,705, filed on May 24, 2016, now Pat. No. 10,397,710.

(Continued)

(51) Int. Cl.
*H04R 25/00* (2006.01)

(52) U.S. Cl.
CPC ..... *H04R 25/30* (2013.01); *H04R 25/407* (2013.01); *H04R 25/505* (2013.01); *H04R 25/70* (2013.01);

(Continued)

(58) Field of Classification Search
CPC ..... H04R 2225/021; H04R 2430/23; H04R 25/70; H04R 25/30; H04R 25/407; H04R 25/505; H04R 25/39

(Continued)

(56) References Cited

U.S. PATENT DOCUMENTS 5,645,074 A 7/1997 Shennib et al.
7,864,968 B2 1/2011 Kulkarni et al.

(Continued)

FOREIGN PATENT DOCUMENTS

EP 2843971 A1 3/2015
EP 2928211 A1 10/2015
JP 2010171688 A1 8/2010

OTHER PUBLICATIONS

International Search Report and Written Opinion issued in PCT/IB2016/057749, dated Apr. 10, 2017 (13 pages).

(Continued)

*Primary Examiner* — Phylesha Dabney
(74) *Attorney, Agent, or Firm* — Edell, Shapiro & Finnan, LLC

(57) ABSTRACT

Disclosed embodiments include systems and methods of configuring, e.g., a hearing prosthesis comprising a beamforming microphone array having two or more microphones. Some embodiments include (i) storing a plurality of sets of beamformer coefficients in memory, where each set of beamformer coefficients corresponds to one of a plurality of zones on a recipient's head, and (ii) configuring the hearing prosthesis with a set of beamformer coefficients that corresponds to the zone on the recipient's head where the beamforming microphone array is located. Other embodiments include determining a set of beamformer coefficients based on magnitude and phase differences between microphones of the beamforming array, where the magnitude and phase differences are determined from a plurality of head related transfer function measurements for the microphones.

20 Claims, 11 Drawing Sheets

Related U.S. Application Data

(60) Provisional application No. 62/269,119, filed on Dec. 18, 2015.

(52) U.S. Cl.
CPC .... *H04R 2225/021* (2013.01); *H04R 2225/39* (2013.01); *H04R 2430/23* (2013.01)

(58) Field of Classification Search
USPC ..... 381/313
See application file for complete search history.

(56) References Cited

U.S. PATENT DOCUMENTS

| | | | | |
|---|---|---|---|---|
| 7,995,771 | B1 | 8/2011 | Faltys et al. | |
| 2004/0076301 | A1 | 4/2004 | Algazi et al. | |
| 2004/0136541 | A1 | 7/2004 | Hamacher et al. | |
| 2008/0201138 | A1 | 8/2008 | Visser et al. | |
| 2011/0255725 | A1 | 10/2011 | Faltys et al. | |
| 2012/0093329 | A1 | 4/2012 | Francart | |
| 2012/0250916 | A1 | 10/2012 | Hain et al. | |
| 2013/0051573 | A1 | 2/2013 | Nishizaki | |
| 2014/0198918 | A1 | 7/2014 | Li et al. | |
| 2015/0256956 | A1 | 9/2015 | Jensen et al. | |
| 2015/0289064 | A1* | 10/2015 | Jensen | H04R 25/50 381/317 |
| 2015/0341729 | A1 | 11/2015 | Meskens | |
| 2017/0180873 | A1 | 6/2017 | Khing et al. | |

OTHER PUBLICATIONS

Extended European Search Report in corresponding European Application No. 16875041.2, dated Apr. 10, 2019, 8 pages.

* cited by examiner

NEUTRALIZING THE EFFECT OF A MEDICAL DEVICE LOCATION

CROSS-REFERENCE TO RELATED APPLICATIONS

This application is a Continuation of U.S. Non-Provisional application Ser. No. 15/162,705, titled "Neutralizing the Effect of a Medical Device Location," which claims priority to U.S. Provisional App. No. 62/269,119, titled "Neutralizing the Effect of a Medical Device Location," filed on Dec. 18, 2015. The entire contents of the 62/269,119 application are incorporated by reference herein for all purposes.

BACKGROUND

Unless otherwise indicated herein, the description in this section is not itself prior art to the claims and is not admitted to be prior art by inclusion in this section.

Various types of medical devices provide relief for recipients with different types of sensorineural loss. For instance, hearing prostheses provide recipients with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea where sound vibrations are converted into neural stimulation signals, or any other part of the ear, auditory nerve, or brain that may process the neural stimulation signals.

Persons with some forms of conductive hearing loss may benefit from hearing prostheses with a mechanical modality, such as acoustic hearing aids or vibration-based hearing devices. An acoustic hearing aid typically includes a small microphone to detect sound, an amplifier to amplify certain portions of the detected sound, and a small speaker to transmit the amplified sounds into a recipient's ear via air conduction. Vibration-based hearing devices typically include a small microphone to detect sound, and a vibration mechanism to apply vibrations corresponding to the detected sound to a recipient's bone, thereby causing vibrations in the recipient's inner ear, thus bypassing the recipient's auditory canal and middle ear via bone conduction. Types of vibration-based hearing aids include bone anchored hearing aids and other vibration-based devices. A bone-anchored hearing aid typically utilizes a surgically implanted abutment to transmit sound via direct vibrations of the skull. Non-surgical vibration-based hearing devices may use similar vibration mechanisms to transmit sound via direct vibration of teeth or other cranial or facial bones. Still other types of hearing prostheses with a mechanical modality include direct acoustic cochlear stimulation devices, which typically utilize a surgically implanted mechanism to transmit sound via vibrations corresponding to sound waves to directly generate fluid motion in a recipient's inner ear. Such devices also bypass the recipient's auditory canal and middle ear. Middle ear devices, another type of hearing prosthesis with a mechanical modality, directly couple to and move the ossicular chain within the middle ear of the recipient thereby bypassing the recipient's auditory canal to cause vibrations in the recipient's inner ear.

Persons with certain forms of sensorineural hearing loss may benefit from cochlear implants and/or auditory brainstem implants. For example, cochlear implants can provide a recipient having sensorineural hearing loss with the ability to perceive sound by stimulating the recipient's auditory nerve via an array of electrodes implanted in the recipient's cochlea. An external or internal component of the cochlear implant comprising a small microphone detects sound waves, which are converted into a series of electrical stimulation signals delivered to the cochlear implant recipient's cochlea via the array of electrodes. Auditory brainstem implants use technology similar to cochlear implants, but instead of applying electrical stimulation to a recipient's cochlea, auditory brainstem implants apply electrical stimulation directly to a recipient's brain stem, bypassing the cochlea altogether. Electrically stimulating auditory nerves in a cochlea with a cochlear implant or electrically stimulating a brainstem can help persons with sensorineural hearing loss to perceive sound.

A typical hearing prosthesis system that provides electrical stimulation (such as a cochlear implant system, or an auditory brainstem implant system) comprises an implanted sub-system and an external (outside the body) sub-system. The implanted sub-system typically contains a radio frequency coil, with a magnet at its center. The external sub-system also typically contains a radio frequency coil, with a magnet at its center. The attraction between the two magnets keeps the implanted and external coils aligned (allowing communication between the implanted and external sub-systems), and also retains the external magnet-containing component on the recipient's head.

The effectiveness of any of the above-described prostheses depends not only on the design of the prosthesis itself but also on how well the prosthesis is configured for or "fitted" to a prosthesis recipient. The fitting of the prosthesis, sometimes also referred to as "programming," creates a set of configuration settings and other data that defines the specific characteristics of how the prosthesis processes external sounds and converts those processed sounds to stimulation signals (mechanical or electrical) that are delivered to the relevant portions of the person's outer ear, middle ear, inner ear, auditory nerve, brain stem, etc.

Hearing prostheses are usually fitted to a prosthesis recipient by an audiologist or other similarly trained medical professional who may use a sophisticated, software-based prosthesis-fitting program to set various hearing prosthesis parameters.

SUMMARY

Hearing prostheses typically have components or algorithms that are affected by a location of the prosthesis as a whole or one or more of its components. For instance, some types of hearing prostheses use a beamforming microphone array to detect sound that the prosthesis then converts to stimulation signals that are applied to the prosthesis recipient. A beamforming microphone array is a set of two or more microphones that enables detecting and processing sound such that the prosthesis recipient experiences sounds coming from one or more specific directions (sometimes referred to herein as the target direction or target location) to be louder than sounds coming from other specific directions (sometimes referred to herein as the attenuation direction or attenuation location). For example, a hearing prosthesis with a beamforming microphone array can be configured to cause sounds from in front of the recipient to be louder than sounds from behind the recipient by exploiting the phase difference between the output of microphones in the beamforming microphone array.

In operation, a hearing prosthesis with a beamforming microphone array is configured with a set of beamformer coefficients. The hearing prosthesis executes a beamformer algorithm that uses the set of beamformer coefficients to process sound received by the beamforming microphone array in a way that amplifies sound coming from a target direction (e.g., in front of the recipient) and attenuates sound coming from an attenuation direction (e.g., behind the recipient). The values of the beamformer coefficients determine the directivity pattern of the beamforming microphone array, i.e. the gain of the beamforming microphone array at each direction. Typically the two or more individual microphones are located on a line that defines an "end-fire" direction, as shown and described in more detail herein with reference to FIGS. 1A and 1B. Typically, the desired target direction 112 is the end-fire direction 108, as shown in FIG. 1A, although it is possible to determine the coefficients such that the target direction 162 is different than the end-fire direction 158, as shown in FIG. 1B.

In some types of hearing prostheses, the beamforming microphone array is contained within a component that the recipient wears "behind the ear" (referred to as a BTE beamforming microphone array). For example, FIG. 1A shows a BTE beamforming microphone array 102 located on a recipient's head 100 behind the recipient's ear 110. The BTE beamforming microphone array 102 comprises a first microphone 104 and a second microphone 106. In operation, a hearing prosthesis with such a BTE beamforming microphone array 102 is typically configured so that the target direction 112 is the end-fire direction 108, and the same set of beamformer coefficients is used for every recipient. This typically gives acceptable performance, because wearing the beamforming microphone array 102 behind the ear 110 means that the alignment of the individual microphones 104, 106 is fairly consistent between recipients, i.e. the end-fire direction 108 of the BTE beamforming microphone array 102 is very close to the desired front direction 112 for every recipient.

In other types of hearing prostheses, the beamforming microphone array is contained within a component that the recipient wears "off the ear" (referred to as an OTE beamforming microphone array), as shown in FIG. 1B. For example, FIG. 1B shows an OTE beamforming microphone array 152 located on a recipient's head 150 off the recipient's ear 160. The OTE beamforming array 152 comprises a first microphone 154 and a second microphone 156.

In a cochlear implant system with such an OTE beamforming microphone array, the location of the beamforming microphone array 152 on the recipient's head 150 is determined by the location of the implanted device (specifically, the implanted magnet). Similarly in a bone-anchored hearing aid, the OTE beamforming microphone array is contained in a component that is mounted on the abutment, and thus the location of the OTE beamforming microphone array on the recipient's head is determined by the location of the implanted abutment.

In both the cochlear implant system and the bone-anchored hearing aid, it is typically preferable for the surgeon to position the implanted device at a "nominal" or ideal location behind the recipient's ear 160. But in practice, implant placement may vary from recipient to recipient, and for some recipients, the resulting placement of the OTE beamforming microphone array 152 may be far from the "nominal" or ideal location for a variety of reasons, such as the shape of the recipient's skull, the recipient's internal physiology, or perhaps the skill or preference of the surgeon. In some situations, because of the curvature of the skull, the end-fire direction 158 of an OTE beamforming microphone array 152 may not be directly in front of the recipient in the desired target location 162, but will be angled to the side, as shown in FIG. 1B.

A hearing prosthesis with such an OTE beamforming microphone array 152 can be configured based on an assumption that the OTE beamforming microphone array 152 will be located on the recipient's head 150 at the above-described "nominal" or ideal location. A typical OTE beamforming microphone array using this sort of "one size fits all" set of beamformer coefficients tends to provide reasonably adequate performance (in terms of amplifying sound from in front of the recipient and attenuating sound from behind the recipient) as long as the OTE beamforming microphone array 152 is located at (or at least very close to) the "nominal" location. However, a typical hearing prosthesis using this sort of "one size fits all" set of beamformer coefficients for the OTE beamforming microphone array 152 often provides inadequate performance (in terms of amplifying sound from in front of the recipient and attenuating sound from behind the recipient) when the OTE beamforming microphone array 152 is in a location other than the "nominal" or ideal location. In practice, the farther the OTE beamforming microphone array 152 is away from the "nominal" location, the worse the hearing prosthesis tends to perform, in terms of amplifying sound from in front of the recipient and attenuating sound from behind the recipient.

To overcome the above-mentioned and other shortcomings of existing hearing prostheses equipped with beamforming microphone arrays, some embodiments of the disclosed systems and methods include (i) making a measurement of one or more spatial characteristics of a beamforming microphone array during a fitting session, (ii) using the measured spatial characteristics of the beamforming microphone array to determine a set of beamformer coefficients, and (iii) configuring the hearing prosthesis with the determined set of beamformer coefficients. In some embodiments, making a measure of one or more spatial characteristics of the beamforming microphone array includes determining a physical position on the recipient's head where the beamforming microphone array has been placed. Additionally or alternatively, in some embodiments, making a measure of one or more spatial characteristics of the beamforming microphone array includes determining one or more head related transfer functions for individual microphones in the beamforming microphone array.

Some embodiments of the disclosed systems and methods may additionally or alternatively include (i) storing a plurality of sets of beamformer coefficients in a tangible, non-transitory computer-readable memory, wherein each set of beamformer coefficients corresponds to one of a plurality of zones on a recipient's head, and (ii) after a beamforming microphone array (e.g., an array of two or more microphones) has been placed on the recipient's head at a location within one of the plurality of zones on the recipient's head, configuring the hearing prosthesis with a set of beamformer coefficients that corresponds to the zone on the recipient's head within which the beamforming microphone array has been placed. Thus, rather than a "one size fits all" set of beamformer coefficients, hearing prostheses according to some embodiments can be configured with any one of a plurality of sets of beamformer coefficients, and in particular, with a set of beamformer coefficients that corresponds to the particular location on the recipient's head where the beamforming microphone array is located.

Some embodiments may further comprise methods of determining a zone on the recipient's head where the beamforming microphone array of the hearing prosthesis is located.

For example, in some embodiments, determining the zone on the recipient's head where the beamforming microphone array of the hearing prosthesis is located comprises comparing (a) the location of the beamforming microphone array on the recipient's head with (b) a zone map overlaid on the recipient's head, wherein the zone map displays each zone of the plurality of zones.

In some embodiments, the zone map may be a sheet of paper, plastic, silicone, or other material that is placed on the recipient's head in the area behind the recipient's ear so that a clinician can compare the zones shown on the zone map with the location on the recipient's head of the beamforming microphone array to determine the zone on the recipient's head where the beamforming microphone array is located.

In another example, the zone map may be an image projected onto the recipient's head by an optical projector, which enables a clinician to compare the zones shown on the zone map projected onto the recipient's head with the location on the recipient's head of the beamforming microphone array to determine the zone on the recipient's head where the beamforming microphone array is located.

After determining the zone on the recipient's head where the beamforming microphone array is located, the hearing prosthesis is configured with the set of beamformer coefficients (selected from the plurality of sets of beamformer coefficients) that corresponds to that zone.

Other embodiments include, (i) while the recipient is positioned at a predetermined location relative to one or more loudspeakers, playing one or more calibration sounds from the one or more loudspeakers and recording the one or more calibration sounds with the beamforming microphone array, (ii) for each set of beamformer coefficients (of the plurality of sets of beamformer coefficients), generating a processed recording by applying the set of beamformer coefficients to the recording, and calculating a performance metric for the processed recording, and (iii) selecting the set of beamformer coefficients corresponding to the processed recording having the best performance metric of the calculated performance metrics. In this manner, the best performing set of beamformer coefficients can be selected without necessarily referring to the zone map (although a zone map could still be used).

Still further embodiments include (i) playing a first set of calibration sounds from a loudspeaker positioned at a target location in front of a recipient, (ii) calculating a first head related transfer function for a first microphone based on the first set of calibration sounds from the target location, (iii) calculating a second head related transfer function for a second microphone based on the first set of calibration sounds from the target location, (iv) playing a second set of calibration sounds from a loudspeaker positioned at an attenuation location behind the recipient, (v) calculating a third head related transfer function for the first microphone based on the second set of calibration sounds from the attenuation location, (vi) calculating a fourth head related transfer function for the second microphone based on the second set of calibration sounds from the attenuation location, (vii) calculating magnitude and phase differences between the first microphone and the second microphone for the target and attenuation locations based on the first, second, third and fourth head related transfer functions, (viii) calculating a plurality of beamformer coefficients based on the magnitude and phase differences between the first microphone and second microphone calculated for the target and attenuation locations; and (ix) configuring the hearing prosthesis with the calculated beamformer coefficients.

One advantage of some of the embodiments disclosed herein is that a hearing prosthesis with an off-the-ear (OTE) beamforming microphone array can be configured with a particular set of beamformer coefficients selected (or perhaps calculated) for the actual location and/or orientation of the beamforming microphone array (which is positioned at the location of the implanted device, as described above). Configuring an OTE beamforming microphone array with beamformer coefficients selected (or perhaps calculated) for the actual location and/or orientation of the beamforming microphone array improves the performance of the hearing prosthesis for the recipient, as compared to a "one size fits all" approach that uses a set of standard beamformer coefficients for every recipient. Additionally, by freeing a surgeon from having to place the implanted device as close as possible to the "nominal" or "ideal" location behind the recipient's ear, the surgeon can instead place the implanted device at a location based on surgical considerations (rather than post-operative performance considerations for the hearing prosthesis), which can reduce surgical times and potential complications, thereby leading to improved long term outcomes for the recipient.

This overview is illustrative only and is not intended to be limiting. In addition to the illustrative aspects, embodiments, features, and advantages described herein, further aspects, embodiments, features, and advantages will become apparent by reference to the figures and the following detailed description.

DETAILED DESCRIPTION

Figure 1A:
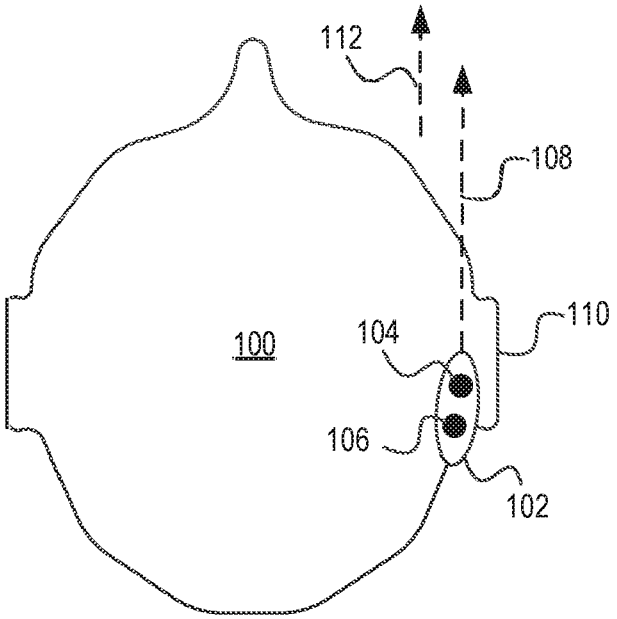
FIG. 1A shows a recipient with a hearing prosthesis comprising a behind-the-ear (BTE) beamforming array of microphones.

FIG. 1A shows a recipient 100 with a hearing prosthesis comprising a behind-the-ear (BTE) beamforming array of microphones 102 located behind the recipient's ear 110. The BTE beamforming microphone array 102 comprises a first microphone 104 and a second microphone 106. In operation, a hearing prosthesis with such a BTE beamforming microphone array 102 is typically configured so that the target direction 112 in front of the recipient 100 is the end-fire direction 108 of the BTE beamforming array 102. In practice, the same set of beamformer coefficients can be used for every recipient. This typically gives acceptable performance, because wearing the BTE beamforming microphone array 102 behind the ear 110 means that the alignment of the individual microphones 104, 106 is fairly consistent between recipients, i.e. the end-fire direction 108 of the BTE beamforming microphone array 102 is very close to the desired target direction 112 in front of every recipient.

Figure 1B:
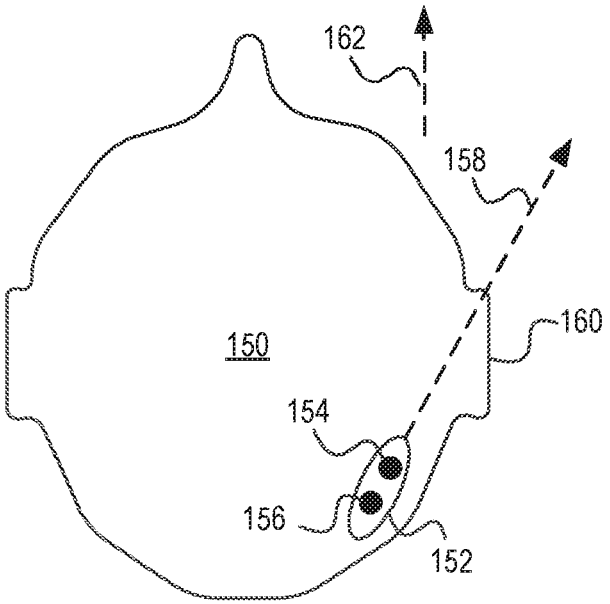
FIG. 1B shows a recipient with a hearing prosthesis comprising an off-the-ear (OTE) beamforming array of microphones.

FIG. 1B shows a recipient 150 with a hearing prosthesis comprising an off-the-ear (OTE) beamforming array of microphones 152. The OTE beamforming microphone array 152 comprises a first microphone 154 and a second microphone 156. Because the location of the OTE beamforming array 152 may vary from recipient to recipient as described herein, the end-fire direction 158 of the OTE beamforming array of microphones 152 may not align very well with the desired target direction 162 in front of every recipient. But as described herein, the hearing prosthesis can be configured with a set of beamforming coefficients for the OTE beamforming microphone array 152 to amplify sounds from the target direction 162 in front of the recipient 150.

Figure 2:
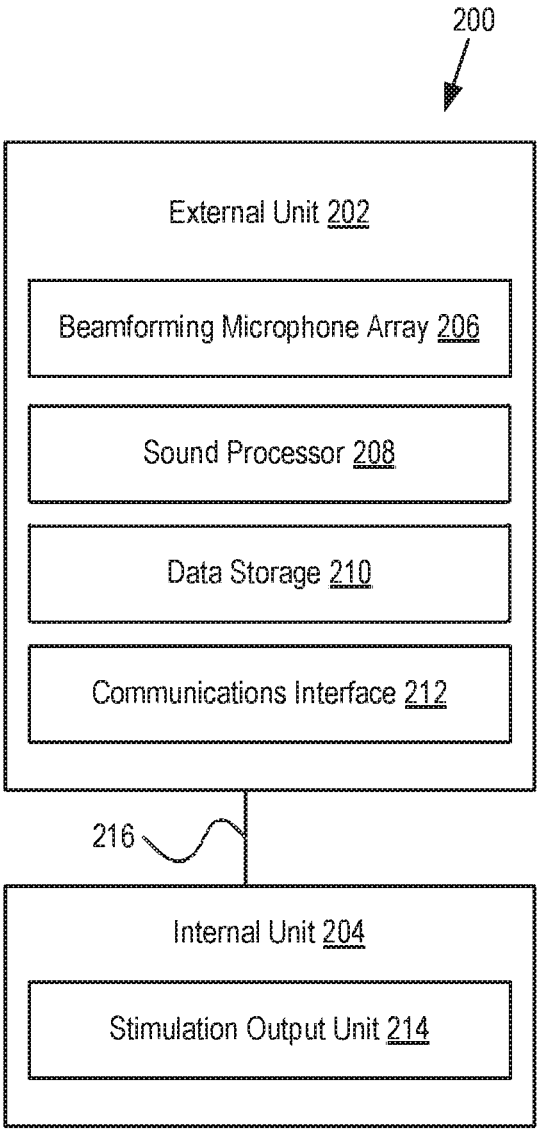
FIG. 2 shows a block diagram of components in an example hearing prosthesis according to some embodiments of the disclosed systems and methods.

FIG. 2 shows a block diagram of components in an example hearing prosthesis 200 according to some embodiments of the disclosed systems and methods. In operation, the hearing prosthesis 200 can be any type of hearing prosthesis that uses a beamforming microphone array configured to detect and process sound waves in a way that results in the hearing prosthesis 200 being more sensitive to sound coming from one or more specific directions (sometimes referred to herein as the target direction or target location) and less sensitive to sounds coming from other directions (sometimes referred to herein as the attenuation direction or null location).

Example hearing prosthesis 200 includes (i) an external unit 202 comprising a beamforming microphone array 206 (i.e., an array of two or more microphones), a sound processor 208, data storage 210, and a communications interface 212, (ii) an internal unit 204 comprising a stimulation output unit 214, and (iii) a link 216 communicatively coupling the external unit 202 and the internal unit 204. In other embodiments, some of the components of the external unit 202 may instead reside within the internal unit 204 and vice versa. In totally implantable prosthesis embodiments, all of the components shown in hearing prosthesis 200 may reside within one or more internal units (as described in more detail in connection with FIG. 4).

In some embodiments, the beamforming microphone array 206 may include two microphones. In other embodiments, the beamforming microphone array 206 may include three, four or even more microphones. In operation, the beamforming microphone array 206 is configured to detect sound and generate an audio signal (an analog signal and/or a digital signal) representative of the detected sound, which is then processed by the sound processor 208.

The sound processor 208 includes one or more analog-to-digital converters, digital signal processor(s) (DSP), and/or other processors configured to convert sound detected by the beamforming microphone array 206 into corresponding stimulation signals that are applied to the implant recipient via the stimulation output unit 214. In operation, the sound processor 208 uses configuration parameters, including but not limited to one or more sets of beamformer coefficients stored in data storage 210, to convert sound detected by the beamforming microphone array 206 into corresponding stimulation signals for application to the implant recipient via the stimulation output unit 214. In addition to the set of beamformer coefficients, the data storage 210 may also store other configuration and operational information of the hearing prosthesis 200, e.g., stimulation levels, sound coding algorithms, and/or other configuration and operation related data.

The external unit 202 also includes one or more communications interface(s) 212. The one or more communications interface(s) 212 include one or more interfaces configured to communicate with a computing device, e.g., computing device 602 (FIG. 6) or computing device 702 (FIG. 7) over a communication link such as link 608 (FIG. 6), for example. In operation, a computing device may communicate with the hearing prosthesis 200 via the communication interface(s) 212 for a variety of reasons, including but not limited to configuring the hearing prosthesis 200 as described herein.

The one or more communication interface(s) 212 also include one or more interfaces configured to send control information over link 216 from the external unit 202 to the internal unit 204, which includes the stimulation output unit 214. The stimulation output unit 214 comprises one or more components configured to generate and/or apply stimulation signals to the implant recipient based on the control information received over link 216 from components in the external unit 202. In operation, the stimulation signals correspond to sound detected and/or processed by the beamforming microphone array 206 and/or the sound processor 208. In cochlear implant embodiments, the stimulation output unit 214 comprises an array of electrodes implanted in the recipient's cochlea and configured to generate and apply electrical stimulation signals to the recipient's cochlea that correspond to sound detected by the beamforming microphone array 206.

In other embodiments, the stimulation output unit 214 may take other forms. For example, in auditory brainstem implant embodiments, the stimulation output unit 214 comprises an array of electrodes implanted in or near the recipient's brain stem and configured to generate and apply electrical stimulation signals to the recipient's brain stem that correspond to sound detected by the beamforming microphone array 206. In some example embodiments where the hearing prosthesis 200 is a mechanical prosthesis, the stimulation output unit 214 includes a vibration mechanism configured to generate and apply mechanical vibrations corresponding to sound detected by the beamforming microphone array 106 to the recipient's bone, skull, or other part of the recipient's anatomy.

Figure 3:
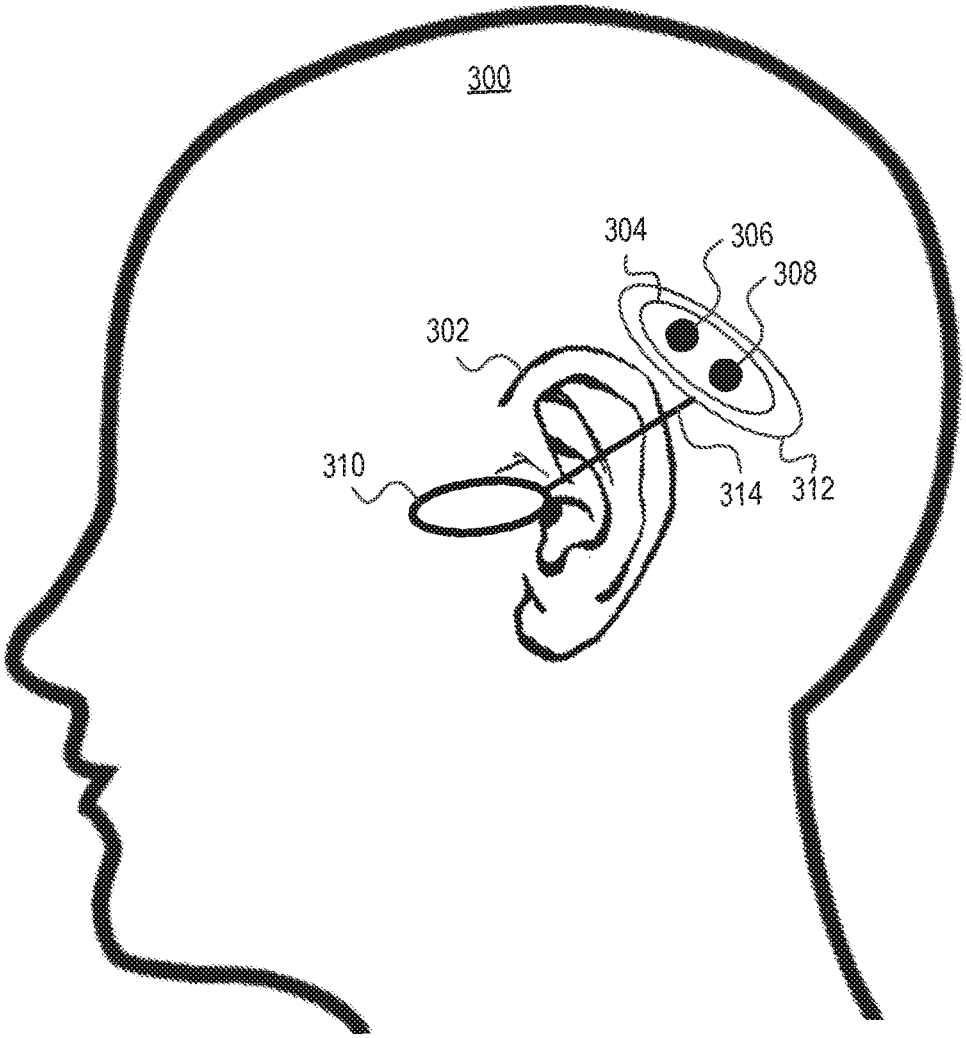
FIG. 3 shows a high-level functional diagram of an example hearing prosthesis comprising an internal component and an external component with a beamforming array of microphones according to some embodiments of the disclosed systems and methods.

FIG. 3 shows a high-level functional diagram of an example hearing prosthesis comprising internal components 310, 312, and 314 and an external component 304, according to some embodiments of the disclosed systems and methods. Internal component 310 corresponds to the stimulation output unit 214 shown and described with reference to FIG. 2. Internal component 312 includes a subcutaneous coil (not shown) and magnet (not shown). The internal components 310 and 312 are communicatively coupled to one another via a communication link 314. The internal component 312 may include the same or similar components as internal unit 204 (FIG. 2) and the external component 304 may include the same or similar components as external unit 202 (FIG. 2). In the example shown in FIG. 3, the external component 304 includes a beamforming microphone array, comprising a first microphone 306 and a second microphone 308. The external component 304 is magnetically mated to the subcutaneous coil in internal component 312 of the prosthesis so that the recipient can remove the external component 304 for showering or sleeping, for example.

Figure 4:
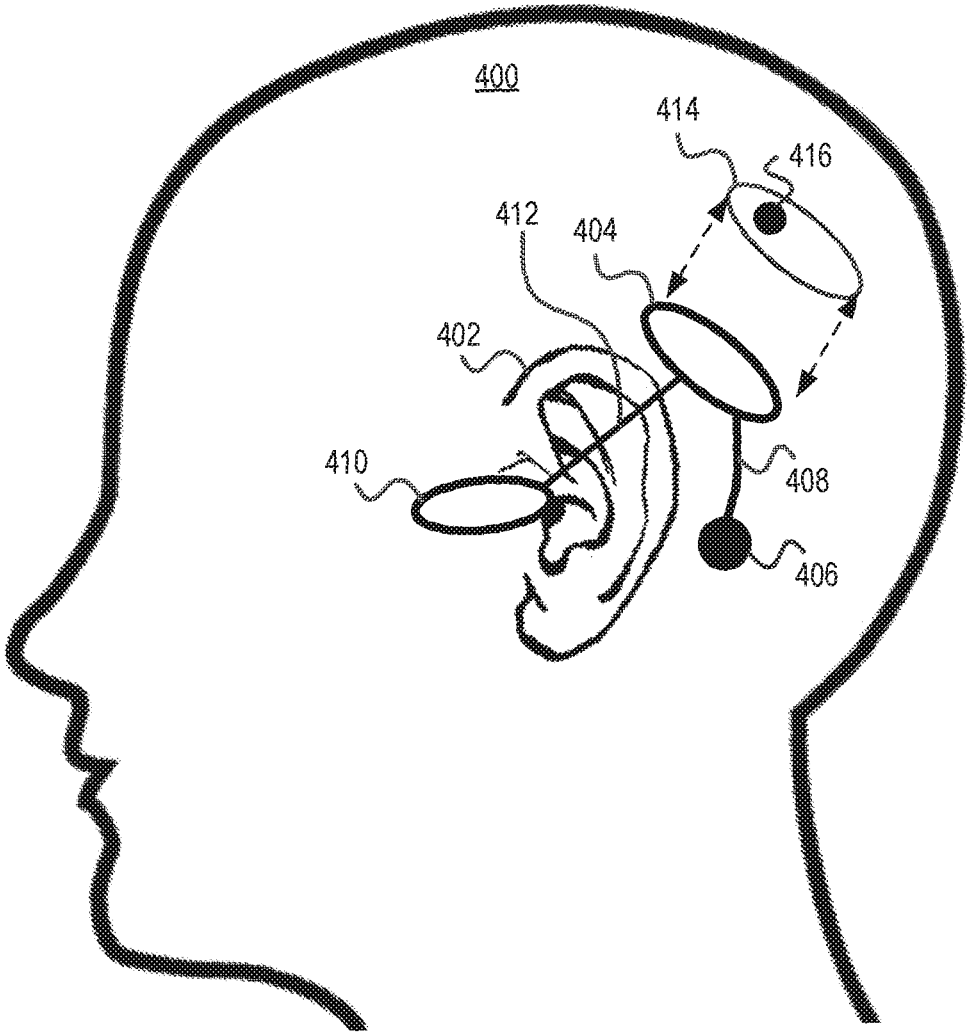
FIG. 4 shows a high-level functional diagram of an example totally implanted hearing prosthesis with a beamforming microphone array that includes a subcutaneous microphone and an external microphone according to some embodiments of the disclosed systems and methods.

FIG. 4 shows a high-level functional diagram of an example totally implanted hearing prosthesis with a beamforming microphone array that includes a subcutaneous microphone 406 (sometimes referred to as a pendant microphone) and an external microphone 416 on an external component 414, according to some embodiments of the disclosed systems and methods.

The internal component 404 includes a subcutaneous coil (not shown) and magnet (not shown), and is communicatively coupled to a stimulation output unit 410 via a communication link 412 and may include the same or similar components as both the internal unit 216 (FIG. 2) and the external unit 202 (FIG. 2). The internal component 404 is communicatively coupled to the subcutaneous microphone 406 via communication link 408.

The external component 414 is attachable to and removable from the recipient's head 400 by magnetically mating the external component 414 with the internal component 404. The external component 414 includes a coil (not shown), battery (not shown), a second microphone 416, and other circuitry (not shown).

In operation, the combination of the subcutaneous microphone 406 and the microphone 416 of the external component 414 can function as a beamforming microphone array for the hearing prosthesis. For example, without the external component 414 magnetically affixed to the recipient's head 400, the hearing prosthesis is configured to generate and apply stimulation signals (electrical or mechanical, depending on the type of prosthesis), based on sound detected by the subcutaneous microphone 406. But when the external component 414 is magnetically mated with the internal component 404, the hearing prosthesis can generate and apply stimulation signals based on sound detected by a beamforming microphone array that includes both (i) the subcutaneous microphone 406 and (ii) the microphone 416 of the external component 414. In some embodiments, the prosthesis may use a set of beamforming coefficients for the beamforming array of the two microphones 416, 406 in response to determining that the external component 414 has been magnetically mated to the internal component 404.

Although FIG. 4 shows only a single subcutaneous microphone 406, and a single external microphone 416, other embodiments may include multiple subcutaneous microphones, for example, two or more subcutaneous microphones, or multiple external microphones, for example, two or more external microphones. In such embodiments, all of the microphones, or any subset of the microphones, may comprise a beamforming microphone array for the prosthesis. When the external component 414 is magnetically mated to internal component 404, the hearing prosthesis can use the multiple subcutaneous microphones and the multiple external microphones as a beamforming microphone array. In operation, such a hearing prosthesis may use one set of beamformer coefficients when the beamforming microphone array is the set of two or more subcutaneous microphones, but use a different set of beamformer coefficients when the beamforming microphone array includes both subcutaneous microphones and external microphones.

As can be seen from FIG. 4, such systems introduce an additional element of complexity. For instance, both the subcutaneous microphone 406 and the external microphone 416 can be located outside of their respective "nominal" or ideal location.

Figure 5:
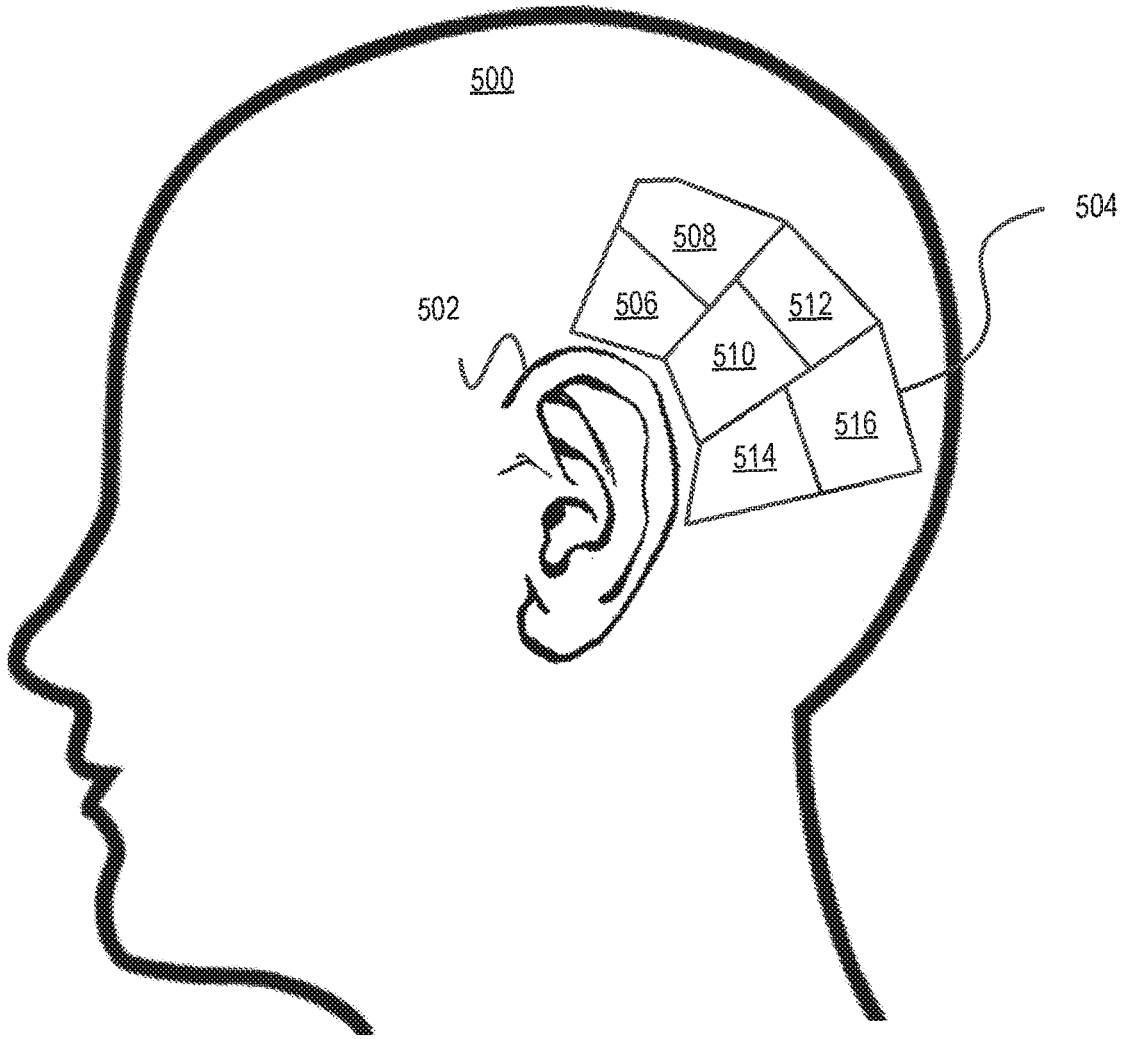
FIG. 5 shows a zone map according to some embodiments of the disclosed systems and methods.

FIG. 5 shows an example zone map 504 for determining a zone on the recipient's head 200 where the beamforming microphone array associated with a hearing prosthesis is located.

The zone map 504 shows a plurality of zones comprising zone 506, zone 508, zone 510, zone 512, zone 514, and zone 516. Although six zones are shown in the plurality of zones of the example zone map 504 in FIG. 5, in other embodiments, the zone map 504 may include more or fewer zones.

In operation, a clinician fitting the prosthesis for the recipient compares the location of the beamforming microphone array to the zone map 504 overlaid on the recipient's head 500. Each zone (i.e., zone 506, zone 508, zone 510, zone 512, zone 514, and zone 516) of the plurality of zones of the zone map 504 corresponds to a set of beamformer coefficients for use with the beamforming microphone array, such as any of the beamforming arrays disclosed and/or described herein.

In some embodiments, the zone map 504 may be a sheet of paper, plastic, or silicone that the clinician places on the recipient's head or at least near the recipient's head for reference to determine which zone of the plurality of zones (506-516) in which the beamforming microphone array is located.

In some embodiments, the zone map 504 comprises an image projected onto the recipient's head 500 for reference to determine which zone of the plurality of zones (506-516) in which the beamforming microphone array is located. In operation, a clinician can refer to the projection of the zone map 504 on the recipient's head to determine the zone in which the beamforming microphone array is located.

In some embodiments, an imaging system may obtain an image of at least a portion of the recipient's head 500, including the recipient's ear 502 and the beamforming microphone array. The imaging system may then process the image to determine the location on the recipient's head 500 of the beamforming microphone array.

In some embodiments, the imaging system may be a computing device (e.g., computing device 602 (FIG. 6), computing device 702 (FIG. 7), or any other type of computing device) equipped with a camera and/or other imaging tool for capturing an image of the recipient's head 500. In some embodiments, the computing device is configured to compare the image with a virtual or logical zone map stored in memory to determine which zone of the plurality of zones in which the beamforming microphone array is located. Instead of a zone map, some embodiments may alternatively use some other type of data structure that includes a correlation or other mapping of locations or regions on the recipient's head with corresponding sets of beamformer coefficients to select an appropriate set of beamformer coefficients (based on the location of the beamforming microphone array) and then configure the hearing prosthesis with the selected set of beamformer coefficients.

Additionally or alternatively, the clinician may measure the distance between the beamforming microphone array and the recipient's ear 502 with a ruler, measuring tape, or laser measuring tool (or other measuring device or tool) to either determine the location of the beamforming microphone array or to verify that the zone indicated by the zone map 504 is consistent with the actual location of the beamforming microphone array (e.g., to check that the zone map 504 was placed correctly on the recipient's head). For example, the clinician may measure the height above (or below) the recipient's ear 502 and the distance behind the recipient's ear 502 to determine the location of the beamforming microphone array. Similarly, the clinician may use a ruler, measuring tape, or laser measuring tool (or other measuring device) to verify that the zone in which the beamforming microphone array is located as indicated by the zone map 504 is consistent with the actual location of the beamforming microphone array on the recipient's head 500.

Regardless of the method or mechanism used to determine the zone on the recipient's head 500 in which the beamforming microphone array is located, once the zone has been determined, the hearing prosthesis can be configured with the set of beamformer coefficients corresponding to the determined zone. In some embodiments, a computing device stores the plurality of sets of beamformer coefficients, and configuring the hearing prosthesis with the set of beamformer coefficients corresponding to the determined zone includes the clinician using the computing device to (i) select the determined zone and (ii) download the corresponding set of beamformer coefficients to the hearing prosthesis.

Figure 6:
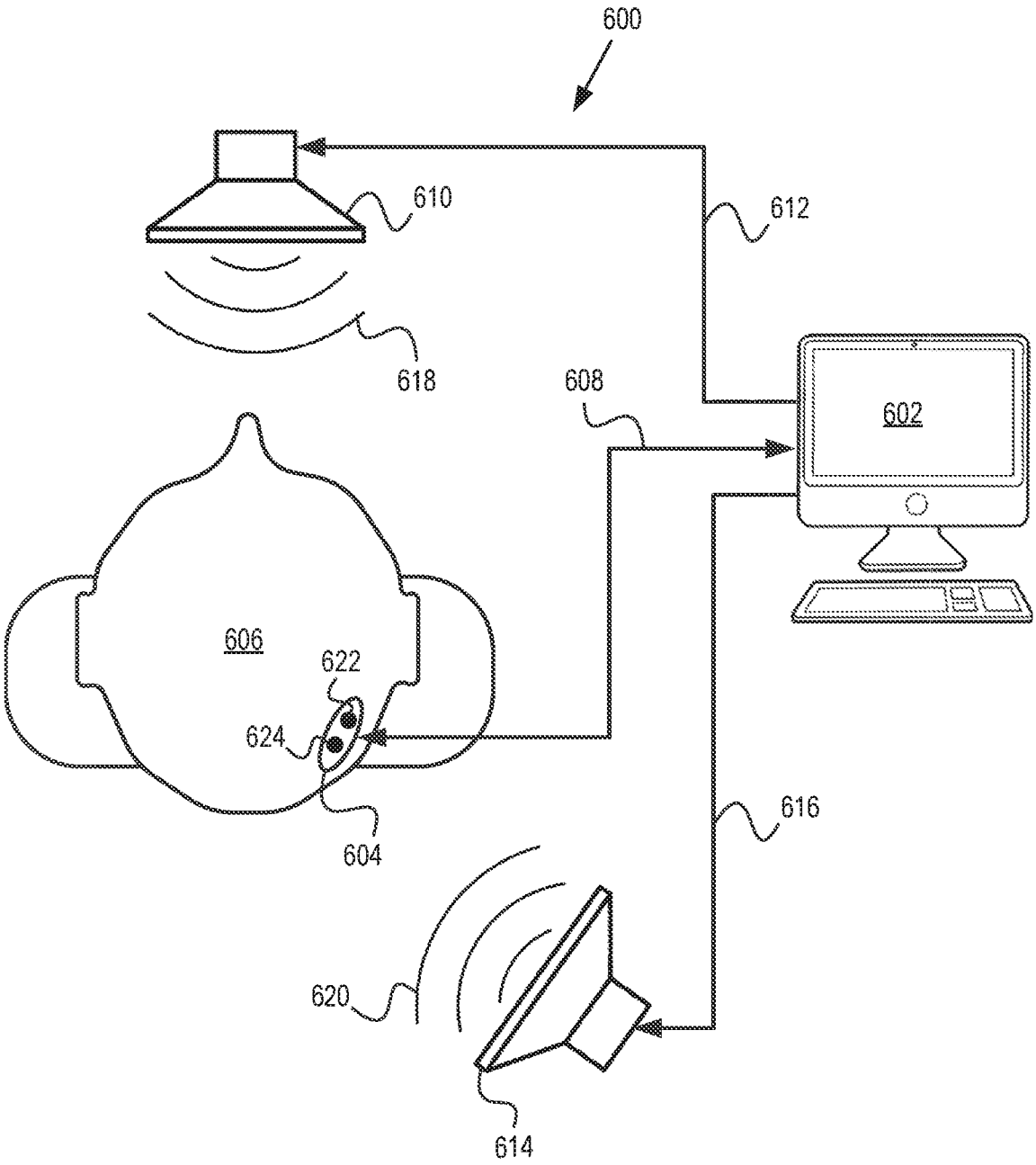
FIG. 6 shows an example hearing prosthesis fitting environment according to some embodiments of the disclosed systems and methods.

FIG. 6 shows an example hearing prosthesis fitting environment 600 according to some embodiments of the disclosed systems and methods.

Example fitting environment 600 shows a computing device 602 connected to (i) a hearing prosthesis with a beamforming microphone array 604 being worn off the ear, on the head of a recipient 606, and connected to the computing device 602 via link 608, (ii) a first loudspeaker 610 connected to the computing device 602 via link 612, and (iii) a second loudspeaker 614 connected to the computing device 602 via link 616. Links 608, 612, and 618 may be any type of wired, wireless, or any other type of communication link now known or later developed. The beamforming microphone array has a first microphone 622 and a second microphone 624. Other embodiments may include more than two microphones. In some embodiments, one or more (or perhaps all) of the microphones of the beamforming microphone array may be internal microphones (e.g., subcutaneous or pendant microphones). In some embodiments, the beamforming microphone array may include a combination of internal and external microphones.

In still other embodiments, one or more of the microphones in the beamforming microphone array do not fit within or are not associated with a zone described above in connection with FIG. 5. In some such embodiments, some microphones included in the beamforming microphone array are on opposite sides of the recipient's head. In other such embodiments, a microphone included in the beamforming microphone array is not located on the recipient, but is instead disposed on a device that can be held away from the body. Thus, in some embodiments, determining a zone for just some of the microphones in the beamforming microphone array has beneficial effects.

In operation, the computing device 602 stores a plurality of sets of beamformer coefficients in memory (e.g., a tangible, non-transitory computer-readable storage memory) of the computing device 602. In some embodiments, each set of beamformer coefficients stored in the tangible, non-transitory computer-readable memory corresponds to one zone of a plurality of zones on a recipient's head. In some embodiments, the hearing prosthesis may store the plurality of sets of beamformer coefficients. In still further embodiments, the hearing prosthesis may store at least some sets of the plurality of sets of beamformer coefficients and the computing device 602 may store some (or all) of the sets of plurality of sets of beamformer coefficients.

The computing device 602 configures the hearing prosthesis with a selected set of beamformer coefficients from the plurality of sets of beamformer coefficients, wherein the selected set of beamformer coefficients corresponds to the zone on the recipient's head where the beamforming microphone array 604 is located.

Sometimes, the beamforming microphone array location on the recipient's head might straddle two or more zones. For example, with reference to FIG. 5, the beamforming array of microphones might be located at the border between zone 508 and zone 512, thereby making it difficult to determine whether the hearing prosthesis should be configured with the set of beamformer coefficients for zone 508 or 512. In another example, the beamforming array of microphones might be located on the recipient's head at the intersection of zones 510, 514, and 516, thereby making it difficult to determine whether the hearing prosthesis should be configured with the set of beamformer coefficients for zone 510, 514, or 516.

Therefore, in some embodiments, the computing device 602 may select a set of beamformer coefficients from the plurality of sets of beamformer coefficients by evaluating the performance of multiple sets of beamformer coefficients, selecting the best performing set of beamformer coefficients, and configuring the hearing prosthesis with the selected best performing set of beamformer coefficients. Some embodiments may additionally or alternatively include selecting from the set of performance metrics the set of beamformer coefficients corresponding to the processed recording according to a criterion, wherein the criterion is attenuation, for example front-to-back ratio. In some embodiments, the computing device 602 may evaluate every set of beamformer coefficients in the plurality of sets of beamformer coefficients, or just the sets of beamformer coefficients for the immediate zones surrounding the location of the beamforming microphone array. For example, with reference to FIG. 5 again, in the above-described scenario where the beamforming microphone array is located at the border of zones 508 and 512, the computing device 502 may evaluate the performance of the sets of beamformer coefficients for zones 508 and 512. Similarly, in the above-described scenario where the beamforming microphone array is located at the intersection of zones 510, 514, and 516, the computing device 602 may evaluate the performance of the sets of beamformer coefficients for zones 510, 514, and 516. However, in some embodiments, the computing device 602 may evaluate the performance of each set of beamformer coefficients (e.g., evaluate the performance of the sets of beamformer coefficients for each of the plurality of zones 506-516). Some embodiments may additionally or alternatively include determining a set of beamformer coefficients via an interpolation of two or more sets of beamformer coefficients in scenarios where the beamforming microphone array is located at or near an intersection of two or more zones.

In some embodiments, the recipient 606 is positioned at a predetermined location relative to the first loudspeaker 610 and the second loudspeaker 614. The first loudspeaker 610 is at a desired target location in front of the recipient 606, and the second loudspeaker 614 is at a desired attenuation location behind the recipient 606. The computing device 602 will configure the hearing prosthesis with a selected set of beamformer coefficients that will cause the beamforming microphone array 604 to (i) amplify (or at least reduce the attenuation of) sounds coming from the target location and (ii) attenuate (or at least reduce amplification of) sounds coming from the attenuation location.

To determine the selected set of beamformer coefficients that will amplify (or at least minimize the attenuation of) sounds coming from the target location and attenuate (or at least minimize the amplification of) sounds coming from the attenuation location, and while the recipient 606 is positioned at the predetermined location relative to the first loudspeaker 610 and the second loudspeaker 614, the computing device 602 (*i*) plays a first set of one or more calibration sounds 618 from the first loudspeaker 610, (ii) plays a second set of one or more calibration sounds 620 from the second loudspeaker 614, and (iii) records the calibration sounds 618 and calibration sounds 620 with the beamforming microphone array 604. In operation, the hearing prosthesis may record the calibrated sounds and send the recording to the computing device 602 via link 608, or the computing device 602 may record the calibrated sounds in real time (or substantially real time) as they are detected by the beamforming microphone array and transmitted to the computing device 602 via link 608.

Then, for each set of beamformer coefficients, the computing device 602 generates a processed recording by applying the set of beamformer coefficients to the recording and calculating a performance metric for the processed recording. For example, if the computing device 602 had six different sets of beamformer coefficients (e.g., one of each zone in zone map 504 in FIG. 5), the computing device 602 generates six different processed recordings and analyzes each of the six processed recordings to determine which of the processed recordings has the best performance metric(s). Some embodiments may additionally or alternatively include selecting from the set of performance metrics the set of beamformer coefficients corresponding to the processed recording according to a criterion, wherein the criterion is attenuation, for example front-to-back ratio.

In some embodiments, the performance metric may include a level of attenuation. For example, the computing device 602 may (i) determine which set of beamformer coefficients results in the least amount of attenuation (or perhaps greatest amplification) of sound originating from the target location (e.g., the calibration sounds 618 emitted from the first loudspeaker 610) and the greatest amount of attenuation of sound originating from the attenuation location (e.g., the calibration sounds 620 emitted from the second loudspeaker 614), and (ii) configure the hearing prosthesis with the set of beamformer coefficients that results in the least attenuation (or perhaps least amplification) of sounds originating from the target location and the greatest attenuation of sounds originating from the attenuation location.

Alternatively, the computing device 602 may determine a set of beamformer coefficients where (i) the amplification of sounds originating from the target location (e.g., the calibration sounds 618 emitted from the first loudspeaker 610) is above a corresponding threshold level of amplification, or perhaps where the attenuation of sounds originating from the target location is less than a corresponding threshold level of attenuation and/or (ii) the attenuation of sounds originating from the attenuation location (e.g., the calibration sounds 620 emitted from the second loudspeaker 614) is above some corresponding threshold level of attenuation, or perhaps where the amplification of sounds originating from the attenuation location is less than some corresponding amplification threshold.

In some embodiments, the computing device 602 calculates beamformer coefficients based on a magnitude and phase difference between the microphones 622, 624 in the beamforming microphone array 604. Such embodiments include the computing device 602 (*i*) playing a first set of calibrated sounds 618 from loudspeaker 610 positioned at a target direction in front of the recipient 606, (ii) calculating a first head related transfer function (HRTF) for the first microphone 622 and a second HRTF for the second microphone 624 based on the first set of calibrated sounds 618, (iii) playing a second set of calibrated sounds 620 from loudspeaker 614 positioned at an attenuation direction behind the recipient 606, (iv) calculating a third HRTF for the first microphone 622 and a fourth HRTF for the second microphone 624 based on the second set of calibrated sounds 620, (v) calculating a magnitude and phase difference between the first microphone 622 and the second microphone 624 for the target and attenuation directions based on the first, second, third, and fourth HRTFs, and (vi) calculating beamformer coefficients for the hearing prosthesis based on the magnitude and phase difference between the first microphone 622 and the second microphone 624 for the target and attenuation directions. After calculating the beamformer coefficients, the computing device 602 configures the hearing prosthesis with the calculated beamformer coefficients.

Figure 7:
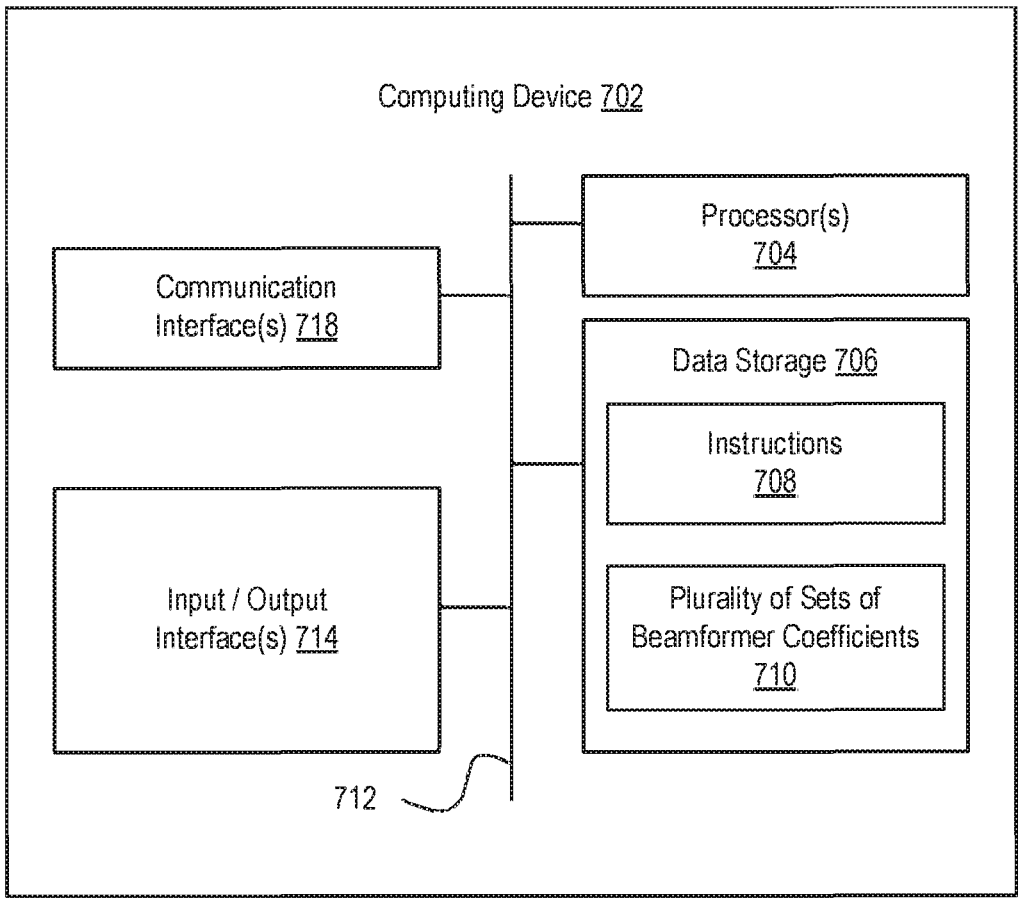
FIG. 7 shows an example computing device for use with configuring a hearing prosthesis according to some embodiments of the disclosed systems and methods.

FIG. 7 shows an example computing device 702 for use with configuring a hearing prosthesis, such as any of the hearing prostheses disclosed and/or described herein.

Computing device 702 includes one or more processors 704, data storage 706 comprising instructions 708 and a plurality of sets of beamformer coefficients 710, one or more communication interface(s) 718, and one or more input/output interface(s) 714, all of which are communicatively coupled to a system bus 712 or similar structure or mechanism that enables the identified components to function together as needed to perform the methods and functions described herein. Variations from this arrangement are possible as well, including addition and/or omission of components, combination of components, and distribution of components in any of a variety of ways.

The one or more processors 704 include one or more general purpose processors (e.g., microprocessors) and/or special purpose processors (e.g., application specific integrated circuits (ASICs), digital signal processors (DSP), or other processors). In some embodiments, the one or more processors 704 may be integrated in whole or in part with one or more of the other components of the computing device 702.

The communication interface(s) 718 includes components (e.g., radios, antennas, communications processors, wired interfaces) that can be configured to engage in communication with a hearing prosthesis and/or to control the emission of sound from loudspeakers (e.g., as shown and described with reference to FIG. 6). For example, the communication interface(s) 718 may include one or more antenna structures and chipsets arranged to support wireless communication (e.g., WiFi, Bluetooth, etc.) and/or wired interfaces (e.g., serial, parallel, universal serial bus (USB), Ethernet, etc.) with a hearing prosthesis and/or one or more loudspeakers (or perhaps systems that control the one or more loudspeakers). In operation, one or more of the communication interface(s) 718 of the computing device 702 are configured to communicate with, for example, one or more communication interface(s) 212 of the hearing prosthesis 200 (FIG. 2) to accomplish a variety of functions, including but not limited to configuring the hearing prosthesis with various operational parameters and settings (e.g., beamformer coefficients).

The data storage 706 comprises tangible, non-transitory computer-readable media, which may include one or more volatile and/or non-volatile storage components. The data storage 706 components may include one or more magnetic, optical, and/or flash memory components and/or perhaps disk storage for example. In some embodiments, data storage 706 may be integrated in whole or in part with the one or more processors 704 and/or the communication interface (s) 718, for example. Additionally or alternatively, data storage 706 may be provided separately as a tangible, non-transitory machine readable medium.

The data storage 706 may hold (e.g., contain, store, or otherwise be encoded with) instructions 708 (e.g., machine language instructions or other program logic, markup or the like) executable by the one or more processors 704 to carry out one or more of the various functions described herein, including but not limited to functions relating to the configuration of hearing prostheses as described herein. The data storage 706 may also hold reference data for use in configuring a hearing prosthesis, including but not limited to a plurality of sets of beamformer coefficients 710 and perhaps other parameters for use with configuring a hearing prosthesis.

The input/output interface(s) 714 may include any one or more of a keyboard, touchscreen, touchpad, screen or display, or other input/output interfaces now known or later developed. In some embodiments, the input/output interface (s) 714 receive an indication of a selected set of beamformer coefficients from an audiologist or other medical professional (or perhaps another user of the computing device 702), and in response, the computing device 702 configures the hearing prosthesis with the selected set of beamformer coefficients.

Figure 8:
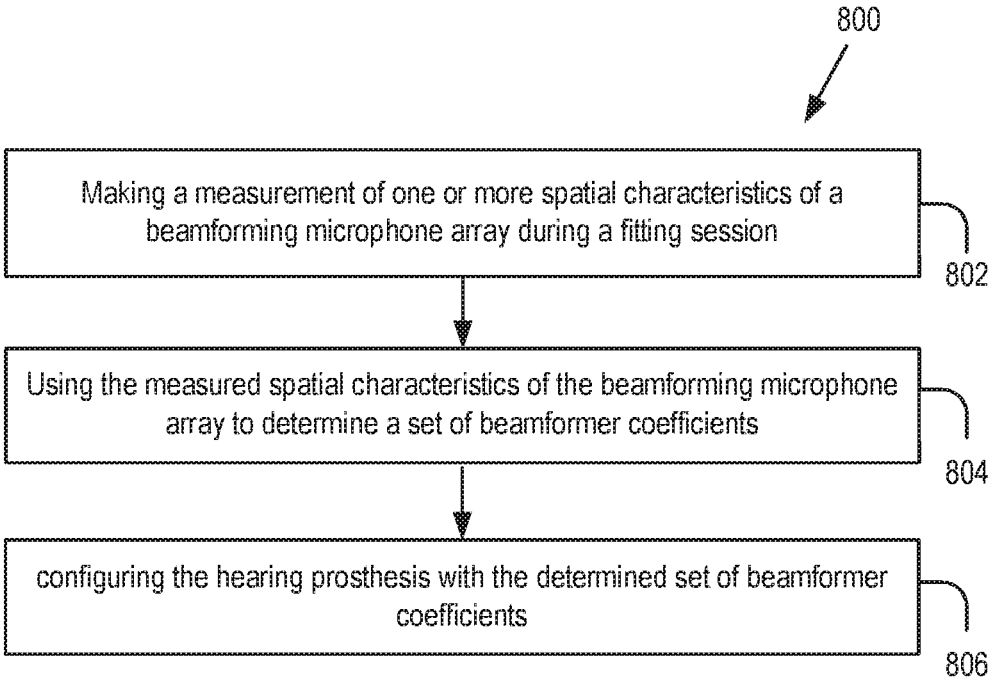
FIG. 8 shows an example method of configuring a hearing prosthesis with a set of beamformer coefficients according to some embodiments.

FIG. 8 shows an example method 800 of configuring a hearing prosthesis with a set of beamformer coefficients. In some embodiments, one or more blocks of method 800 may be implemented by a computing device executing instructions stored in tangible, non-transitory computer-readable media, including but not limited to, for example, computing device 702 shown and described with reference to FIG. 7.

Method 800 begins at block 802, which includes measuring one or more spatial characteristics of a beamforming microphone array during a hearing prosthesis fitting session. In some embodiments, the hearing prosthesis is a cochlear implant. In other embodiments, the hearing prosthesis may be another type of hearing prosthesis that includes a beamforming microphone array, including but not limited to any of the hearing prostheses disclosed and/or described herein In some embodiments, measuring one or more spatial characteristics of the beamforming microphone array includes determining where the beamforming microphone array is physically located on the recipient's head. In some embodiments, measuring one or more spatial characteristics of the beamforming microphone array includes calculating one or more head related transfer functions (HRTFs) for an individual microphone in the beamforming microphone array. In still further embodiments, measuring one or more spatial characteristics of the beamforming microphone array includes calculating one or more HRTFs for each microphone in the beamforming microphone array. In still further embodiments, measuring one or more spatial characteristics of the beamforming microphone array may include a combination of (i) determining where the beamforming microphone array is physically located on the recipient's head and (ii) calculating one or more HRTFs for one or more individual microphones in the beamforming microphone array.

After measuring one or more spatial characteristics of the beamforming microphone array in block 802, method 800 advances to block 804, which includes using the measured spatial characteristics of the beamforming array (from block 802) to determine a set of beamformer coefficients.

For example, if the one or more measured spatial characteristics of the beamforming microphone array includes where the beamforming microphone array is physically located on the recipient's head, determining a set of beamforming coefficients may include any one or more of (i) selecting a set of beamformer coefficients corresponding to a zone on the recipient's head in which the beamforming microphone array is located according to any of the methods or procedures described herein or (ii) selecting a set of beamformer coefficients corresponding to the particular location on the recipient's head in which the beamforming array is located according to any of the methods or procedures described herein.

Similarly, if the one or more measured spatial characteristics of the beamforming microphone array includes one or more HRTFs for one or more of the microphones in the beamforming microphone array, determining a set of beamforming coefficients may include calculating the set of beamformer coefficients based at least in part on phase and magnitude differences between the microphones of the beamforming microphone array according to any of the methods or procedures described herein.

Next, method 800 advances to block 806, which includes configuring the hearing prosthesis with the set of beamformer coefficients determined at block 804.

Figure 9:
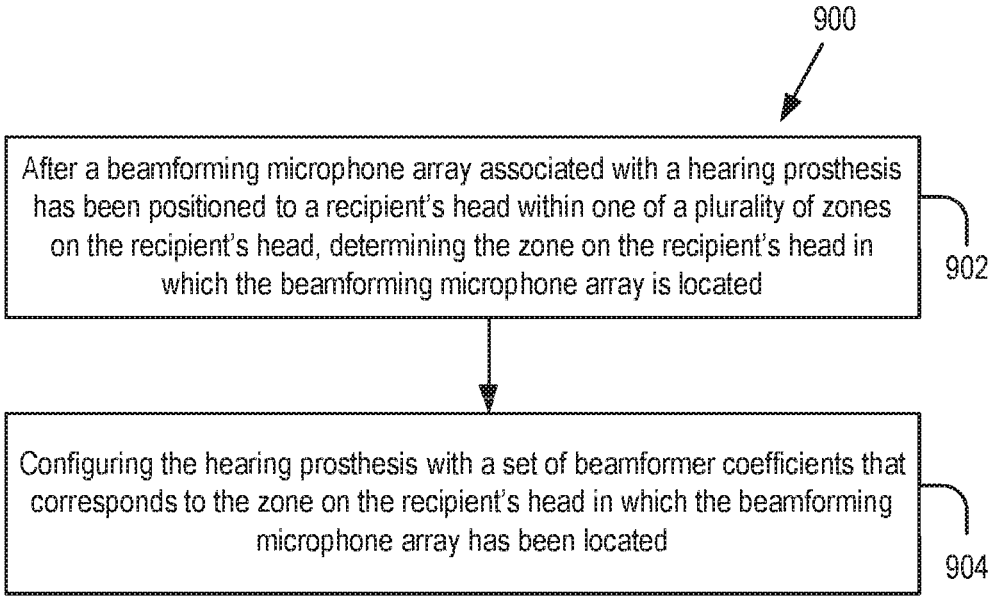
FIG. 9 shows an example method of configuring a hearing prosthesis with a set of beamformer coefficients according to some embodiments.

FIG. 9 shows an example method 900 of configuring a hearing prosthesis with a set of beamformer coefficients. In some embodiments, one or more blocks of method 900 may be implemented by a computing device executing instructions stored in tangible, non-transitory computer-readable media, including but not limited to, for example, computing device 702 shown and described with reference to FIG. 7.

Method 900 begins at block 902, which includes determining the zone on the recipient's head in which the beamforming microphone array associated with the hearing prosthesis is located.

In some embodiments, the hearing prosthesis is a cochlear implant. In other embodiments, the hearing prosthesis may be another type of hearing prosthesis that includes a beamforming microphone array, including but not limited to any of the hearing prostheses disclosed and/or described herein.

In some embodiments, determining the zone on the recipient's head in which the beamforming microphone array associated with the hearing prosthesis is located includes a comparison with a zone map overlaid on the recipient's head, where the zone map displays each zone of the plurality of zones. In such embodiments, the zone map may be any of the zone maps disclosed and/or described herein, including but not limited to zone map 504.

After determining the zone on the recipient's head in which the beamforming microphone array is located in block 902, method 900 advances to block 904, which includes configuring the hearing prosthesis with a set of beamformer coefficients that corresponds to the determined zone.

In some embodiments, each zone on the recipient's head in the plurality of zones on the recipient's head corresponds to a set of beamformer coefficients stored in one or both of (i) the hearing prosthesis and/or (ii) a computing device arranged to configure the hearing prosthesis with the set of beamformer coefficients.

In some embodiments, configuring the hearing prosthesis with a set of beamformer coefficients that corresponds to the zone on the recipient's head within which the beamforming microphone array associated with the hearing prosthesis is located comprises the computing device (i) receiving an indication (e.g., an input from a clinician) of the determined zone via a user interface of the computing device, and (ii) in response to receiving the indication, configuring the hearing prosthesis with the selected set of beamformer coefficients.

Figure 10:
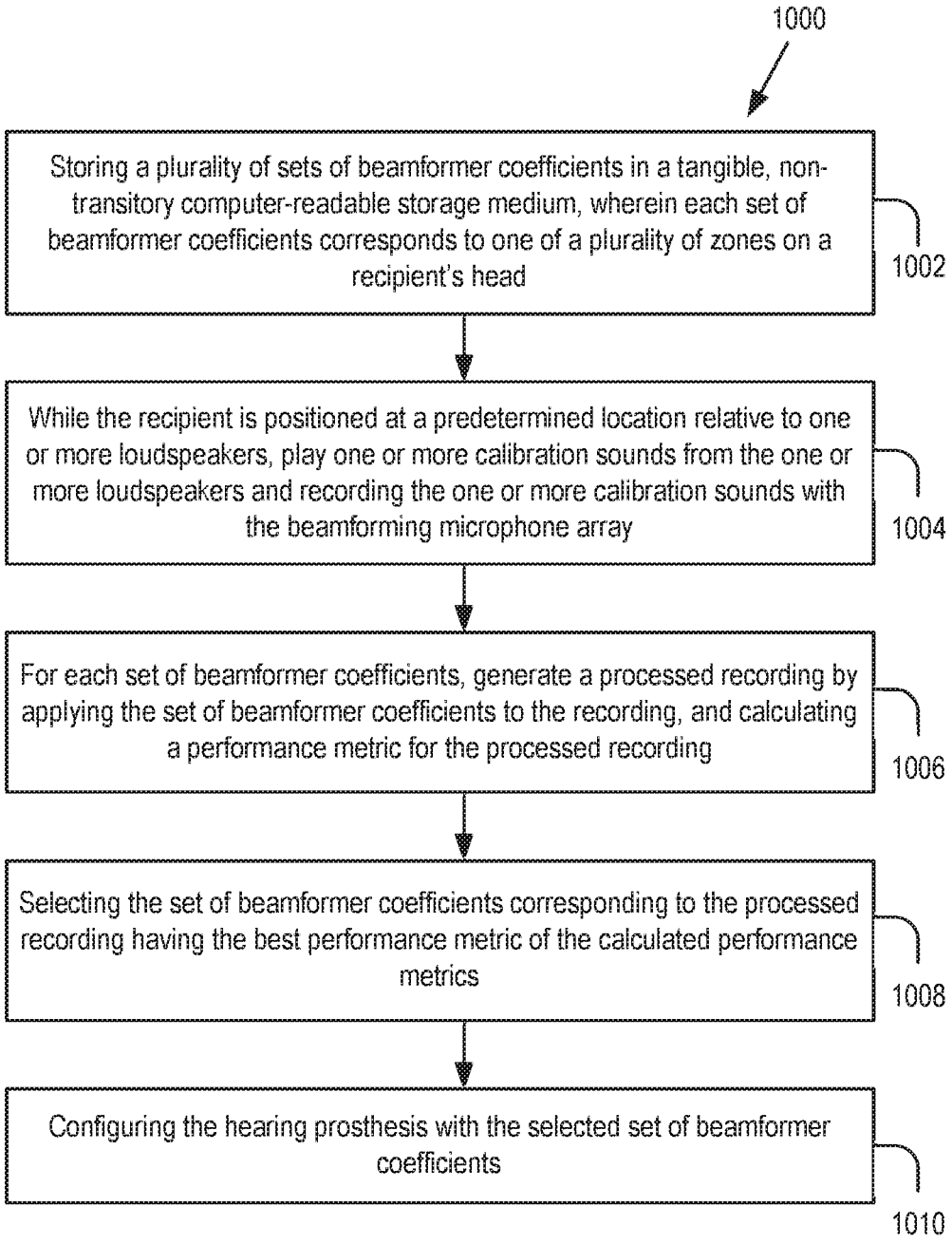
FIG. 10 shows an example method of configuring a hearing prosthesis with a set of beamformer coefficients according to some embodiments.

FIG. 10 shows another example method 1000 of configuring a hearing prosthesis with a set of beamformer coefficients. In some embodiments, one or more blocks of method 1000 may be implemented by a computing device executing instructions stored in tangible, non-transitory computer-readable media, including but not limited to, for example, computing device 702 shown and described with reference to FIG. 7.

In some embodiments, the hearing prosthesis is a cochlear implant. In other embodiments, the hearing prosthesis may be another type of hearing prosthesis that includes a beamforming microphone array, including but not limited to any of the hearing prostheses disclosed and/or described herein Method 1000 begins at block 1002, which includes a computing device storing a plurality of sets of beamformer coefficients in a tangible, non-transitory computer-readable storage medium of the computing device, wherein each set of beamformer coefficients corresponds to one zone of a plurality of zones on a recipient's head.

Next, method 1000 advances to block 1004, which includes, while the recipient of the hearing prosthesis is positioned at a predetermined location relative to one or more loudspeakers, the computing device (alone or perhaps in combination with a playback system in communication with the computing device) playing one or more calibration sounds from the one or more loudspeakers and recording the one or more calibration sounds with the beamforming microphone array associated with the hearing prosthesis.

In some embodiments, block 1004 may be implemented in a hearing prosthesis fitting environment similar to or the same as the one described in FIG. 6, where a first loudspeaker is positioned at a target location and a second loudspeaker is positioned at an attenuation location. In other embodiments, a single loudspeaker may be placed in the target location and then moved to the attenuation location. In other single loudspeaker embodiments, the recipient may first position his or her head such that the loudspeaker is in a target location relative to the recipient's head, and then re-position his or her head such that the loudspeaker is then in an attenuation location relative to the recipient's head. Still further embodiments may utilize more loudspeakers and perhaps more than one target location and/or more than one attenuation location.

After playing and recording the one or more calibration sounds, method 1000 advances to block 1006, which includes, for each set of beamformer coefficients, generating a processed recording by applying the set of beamformer coefficients to the recording, and calculating a performance metric for the processed recording.

For example, if the plurality of sets of beamformer coefficients has ten sets of beamformer coefficients (corresponding to ten zones on the recipient's head), then the computing device (i) generates ten processed recordings (one for each of the ten sets of beamformer coefficients), and (ii) calculates a performance metric for each of the ten processed recordings. Although this example describes the plurality of sets of beamformer coefficients as having ten sets of beamformer coefficients, other examples may have more or fewer sets of beamformer coefficients.

After calculating a performance metric for each of the processed recordings, method 1000 advances to block 1008, which includes the computing device selecting the set of beamformer coefficients corresponding to the processed recording having the best performance metric of the calculated performance metrics.

After selecting the set of beamformer coefficients corresponding to the processed recording having the best performance metric of the calculated performance metrics, method 1000 advances to block 1010, which includes configuring the hearing prosthesis with the selected set of beamformer coefficients.

In some embodiments, the performance metric may include a level of attenuation. For example, the computing device may (i) determine which set of beamformer coefficients results in (i-a) the least amount of attenuation (or perhaps greatest amount of amplification) of sound originating from the target location (e.g., the calibration sounds 618 emitted from the first loudspeaker 610 as in FIG. 6) and (i-b) the greatest amount of attenuation of sound originating from the attenuation location (e.g., the calibration sounds 620 emitted from the second loudspeaker 614 as in FIG. 6), and (ii) configure the hearing prosthesis with the set of beamformer coefficients that results in the least attenuation (or perhaps greatest amplification) of sounds originating from the target location and the greatest attenuation (or perhaps least amplification) of sounds originating from the attenuation location.

In some embodiments, the performance metric may include the difference between the sound from the target location and the sound from the attenuation location. In such embodiments, selecting the set of beamformer coefficients corresponding to the processed recording having the best performance metric of the calculated performance metrics includes selecting the set of beamformer coefficients that results in the greatest difference between sound from the target location as compared to sound from the attenuation location.

Figure 11:
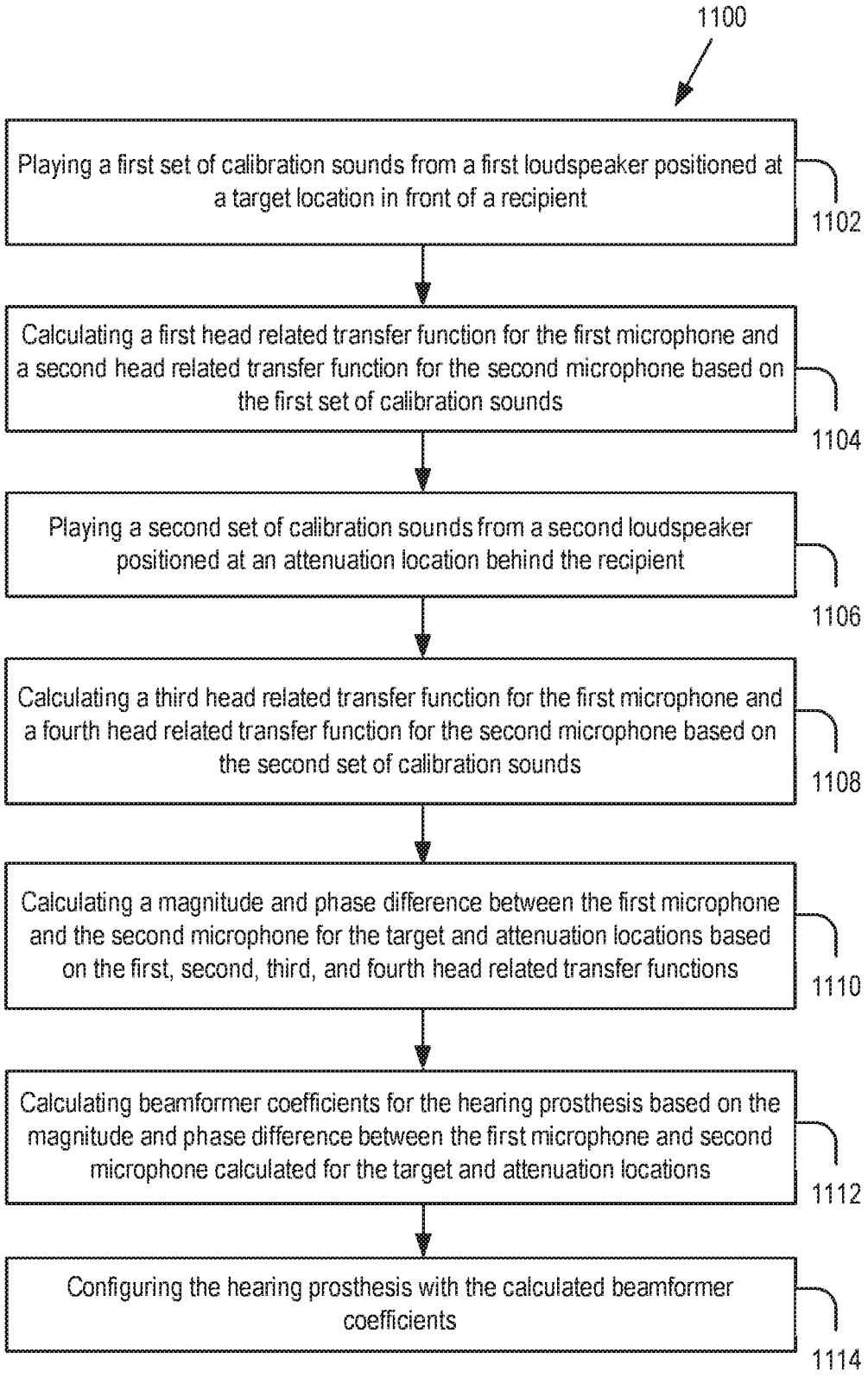
FIG. 11 shows an example method of configuring a hearing prosthesis with a set of beamformer coefficients according to some embodiments.

FIG. 11 shows yet another example method 1100 of configuring a hearing prosthesis with a set of beamformer coefficients for a hearing prosthesis with a beamforming microphone array comprising at least a first microphone and a second microphone. In some embodiments, one or more blocks of method 700 may be implemented by a computing device executing instructions stored in tangible, non-transitory computer-readable media, including but not limited to, for example, computing device 702 shown and described with reference to FIG. 7.

In operation, the beamforming microphone array of the hearing prosthesis comprises a first microphone and a second microphone. In some embodiments, the beamforming microphone array is worn on the recipient's head. In other embodiments, the beamforming microphone array of the hearing prosthesis is positioned under the recipient's skin (e.g., subcutaneous or pendant microphones). In still further embodiments, the beamforming microphone array includes a first pendant microphone positioned under the recipient's skin and one microphone worn on the recipient's head. In some embodiments, the hearing prosthesis is a cochlear implant. In other embodiments, the hearing prosthesis may be another type of hearing prosthesis that includes a beamforming microphone array, including but not limited to any of the hearing prostheses disclosed and/or described herein.

Method 1100 begins at block 1102, which includes playing a first set of calibration sounds from a first loudspeaker positioned at a target location in front of a recipient.

After playing the first set of calibration sounds from the first loudspeaker positioned at the target location in front of the recipient, method 1100 advances to block 1104, which includes calculating a first head related transfer function for the first microphone and a second head related transfer function for the second microphone based on the first set of calibration sounds.

Next, method 1100 advances to block 1106, which includes playing a second set of calibration sounds from a second loudspeaker positioned at an attenuation location behind the recipient. In some embodiments, rather using a first and second loudspeaker positioned at the target and attenuation locations, respectively, the method 1100 may instead include playing the first set of calibration sounds from a single loudspeaker positioned at the target location, moving the single loudspeaker to the attenuation location, and then playing the second set of calibration sounds from the single loudspeaker positioned at the attenuation location. In still other embodiments, rather than moving a single loudspeaker from the target location to the attenuation location, the recipient may instead reposition his or her head relative to the loudspeaker, such that the loudspeaker plays the first set of calibration sounds when the loudspeaker is positioned at the target location relative to the recipient's head and the loudspeaker plays the second set of calibration sounds when the loudspeaker is positioned at the attenuation location relative to the position of the recipient's head.

After playing the second set of calibrated sounds from the second loudspeaker positioned at the attenuation location behind the recipient, method 1100 advances to block 1108, which includes calculating a third head related transfer function for the first microphone and a fourth head related transfer function for the second microphone based on the second set of calibrated sounds.

Next, method 1100 advances to block 1110, which includes calculating magnitude and phase differences between the first microphone and the second microphone for the target and attenuation locations based on the first, second, third, and fourth head related transfer functions.

Then, method 1100 advances to block 1112, which includes calculating beamformer coefficients for the hearing prosthesis based on the magnitude and phase differences between the first and second microphones calculated for the target and attenuation locations.

Next, method 1100 advances to block 1114, which includes configuring the hearing prosthesis with the beamformer coefficients calculated in block 1112.

Figure 12:
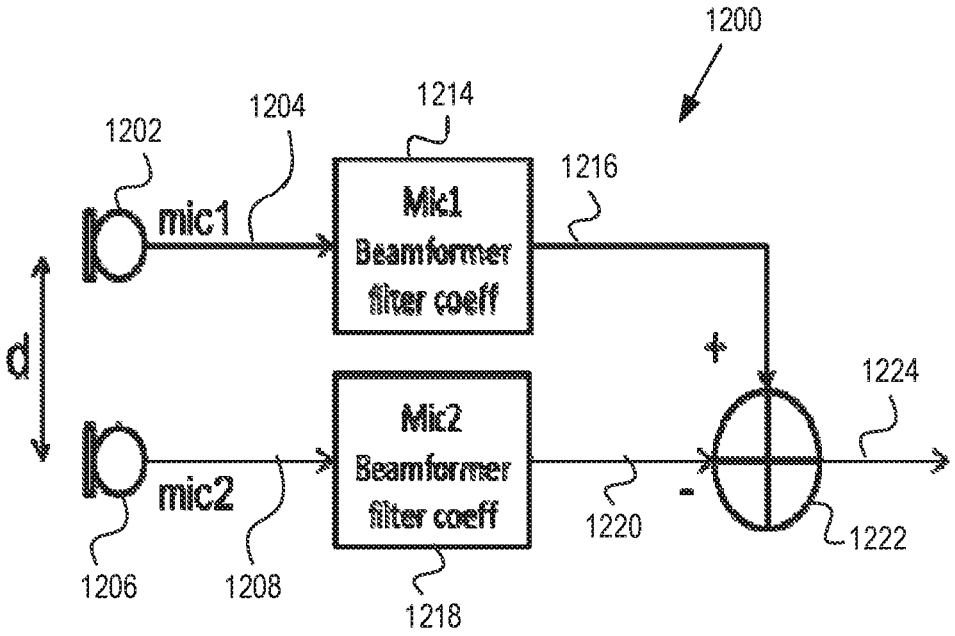
FIG. 12 shows an example of how the calculated beamformer coefficients are implemented with a beamforming microphone array according to some embodiments.

FIG. 12 shows an example of how the calculated beamformer coefficients are implemented with a beamforming microphone array 1200 according to some embodiments of the disclosed systems and methods.

The beamforming microphone array 1200 includes a first microphone 1202 and a second microphone 1206. The output 1204 from the first microphone 1202 is fed to a first filter 1214, which applies a first set of beamformer coefficients and generates a first filtered output 1216. The output 1208 from the second microphone 1206 is fed to a second filter 1218, which applies a second set of beamformer coefficients and generates a second filtered output 1220. The second filtered output 1220 is subtracted from the first filtered output 1216 at stage 1222, which generates the output 1224 of the beamforming microphone array 1200. In some embodiments, the first filter 1214 is a 32-tap finite impulse response (FIR) filter and the second filter 1218 is a 32-tap FIR filter. However, other embodiments may use differently configured FIR filters (e.g., with more or fewer taps) or perhaps filters other than FIR filters.

In some embodiments, calculating the beamformer coefficients for the first filter 1214 and the second filter 1218 includes (i) measuring spatial responses of the first microphone 1202 (e.g., a first HRTF based on a first set of calibration sounds emitted from the target direction and a third HRTF based on the first set of calibration sounds emitted from the attenuation direction) and (ii) measuring spatial responses of the second microphone 1206 (e.g., a second HRTF based on a second set of calibration sounds emitted from the target direction and a fourth HRTF based on the second set of calibrated sounds emitted from the attenuation direction).

In some embodiments, the first set of beamformer coefficients for the first microphone 1202 and the second set of beamformer coefficients for the second microphone 1206 are calculated according to the following equations:

$$\text{Mic}_{1202}\text{_coefficients}=\text{IFFT}(\text{pre-emphasized frequency response})$$

$$\text{Mic}_{1206}\text{_coefficients}=\text{IFFT}(\text{pre-emphasized frequency response}*\text{FFT}(\text{impulse response of Mic}_{1202}\text{ at the attenuated direction})/\text{FFT}(\text{impulse response of Mic}_{1206}\text{ at the attenuated direction}))$$

In the equations above, the pre-emphasized frequency response is derived from the desired pre-emphasis magnitude response and the spatial responses of microphone 1202 and microphone 1206 at the target direction. FFT is Fast Fourier Transform, and IFFT is Inverse Fast Fourier Transform.

While various aspects have been disclosed herein, other aspects will be apparent to those of skill in the art. The various aspects disclosed herein are for purposes of illustration and are not intended to be limiting, with the true scope being indicated by the following claims, along with the full scope of equivalents to which such claims are entitled. It is also to be understood that the terminology used herein is for the purpose of describing particular example embodiments only, and is not intended to be limiting. For example, while specific types of hearing prostheses are disclosed, the disclosed systems and methods may be equally applicable to other hearing prostheses that utilize beamforming microphone arrays. Additionally, disclosed systems and methods are equally applicable to systems that do not utilize beamforming microphone arrays. Indeed, disclosed systems and methods are applicable to any medical device operationally affected by spatial characteristics. For instance, disclosed systems and methods are applicable to hearing prosthesis with microphone assemblies comprising just one microphone in addition to microphone assemblies comprising beamforming microphone arrays.

What is claimed is:

1. A method, comprising:

determining a location of a microphone assembly on a head of a recipient of a hearing prosthesis, wherein the microphone assembly is a component of the hearing prosthesis;

associating the location of the microphone assembly on the head of the recipient with a first head zone selected from a plurality of head zones, wherein each of the plurality of head zones correspond to a different region of the head of the recipient;

determining, based on the first head zone, a set of parameters for the hearing prosthesis; and configuring the hearing prosthesis with the set of parameters.

2. The method of claim 1, wherein the microphone assembly comprises a beamforming microphone assembly that includes at least two microphones.

3. The method of claim 2, wherein the set of parameters for the hearing prosthesis comprise a set of beamformer coefficients.

4. The method of claim 1, wherein the set of parameters is selected from a plurality of sets of parameters stored in a tangible, non-transitory computer-readable memory, and wherein each set of parameters in the plurality of sets of parameters corresponds to at least one of the plurality of head zones on the head of the recipient.

5. The method of claim 1, wherein associating the location of the microphone assembly on the head of the recipient with a first head zone selected from a plurality of head zones, comprises:

comparing the location at which the microphone assembly is located on the head of the recipient to a head zone map, wherein the head zone map displays each of the plurality of head zones.

6. The method of claim 5, wherein comparing the location at which the microphone assembly is located on the head of the recipient to a head zone map comprises:

overlaying the head zone map on the head of the recipient.

7. The method of claim 6, wherein overlaying the head zone map on the head of the recipient, comprising:

overlaying, on the head of the recipient, a head zone map formed from at least one of a sheet of paper, a sheet of plastic, or a sheet of silicone.

8. The method of claim 6, wherein overlaying the head zone map on the head of the recipient, comprising:

projecting an image including a head zone map onto the head of the recipient.

9. The method of claim 1, wherein associating the location of the microphone assembly on the head of the recipient with a first head zone selected from a plurality of head zones, includes:

measuring a distance between the microphone assembly and an ear of the recipient with at least one of a ruler, measuring tape, or laser measuring tool.

10. A tangible, non-transitory computer-readable storage medium having instructions encoded therein, wherein the instructions, when executed by one or more processors, cause a computing device to perform a method comprising:

storing a plurality of sets of beamformer coefficients in the tangible, non-transitory computer-readable storage medium, wherein each set of beamformer coefficients corresponds to one zone of a plurality of zones on a recipient's head; and after a beamforming microphone array of a hearing prosthesis is placed on the recipient's head at a location within one zone of the plurality of zones on the recipient's head, configuring the hearing prosthesis with a selected set of beamformer coefficients from the plurality of sets of beamformer coefficients, wherein the selected set of beamformer coefficients corresponds to the zone on the recipient's head where the beamforming microphone array is placed.

11. The tangible, non-transitory computer-readable storage medium of claim 10, wherein the method further comprises:

determining the zone on the recipient's head where the beamforming microphone array is placed.

12. The tangible, non-transitory computer-readable storage medium of claim 11, wherein determining the zone on the recipient's head where the beamforming microphone array is placed comprises:

obtaining an image of at least a portion of the recipient's head, wherein the image comprises at least an ear of the recipient's head and the beamforming microphone array; and processing the image to determine the zone on the recipient's head where the beamforming microphone array is placed.

13. The tangible, non-transitory computer-readable storage medium of claim 10, wherein configuring the hearing prosthesis with the selected set of beamformer coefficients from the plurality of sets of beamformer coefficients comprises:

configuring the hearing prosthesis with the set of beamformer coefficients in response to receiving a selection of the set of beamformer coefficients via a user interface of the computing device.

14. The tangible, non-transitory computer-readable storage medium of claim 10, wherein configuring the hearing prosthesis with the selected set of beamformer coefficients from the plurality of sets of beamformer coefficients comprises:

while the recipient's head is positioned at a predetermined location relative to one or more loudspeakers, playing one or more calibration sounds from the one or more loudspeakers and recording the one or more calibration sounds with the beamforming microphone array of the hearing prosthesis;

for each set of beamformer coefficients, generating a processed recording by applying the set of beamformer coefficients to the recording, and calculating a performance metric for the processed recording to generate a set of performance metrics; and selecting from the set of performance metrics the set of beamformer coefficients corresponding to the processed recording according to a criterion, wherein the criterion is one of attenuation, amplification, or head related transfer function.

15. The tangible, non-transitory computer-readable storage medium of claim 14, wherein the one or more loudspeakers comprises a first loudspeaker and a second loudspeaker, wherein the first loudspeaker is positioned in front of the recipient's head at a target position, and wherein the second loudspeaker is positioned behind the recipient's head at an attenuation position.

16. A method for configuring a hearing prosthesis configured to be positioned on a head of a recipient, wherein the hearing prosthesis comprises a microphone assembly, the method comprising:

determining a first zone on the head of the recipient at which the microphone assembly is located, wherein the first zone is selected from a plurality of zones each corresponding to a different region of the head of the recipient;

determining, based on the first zone, a first set of parameters for the hearing prosthesis, wherein the a first set of parameters are selected from a plurality of sets of parameters stored in a tangible, non-transitory computer-readable memory, and wherein each set of parameters in the plurality of sets of parameters corresponds to at least one of the plurality of zones on the head of the recipient; and instantiating the first set of parameters at the hearing prosthesis.

17. The method of claim 16, wherein the microphone assembly comprises a beamforming microphone assembly that includes at least two microphones, and wherein the first set of parameters for the hearing prosthesis comprise a first set of beamformer coefficients.

18. The method of claim 16, wherein determining a first zone on the head of the recipient at which the microphone assembly is located comprises:

overlaying a head zone map on the head of the recipient, wherein the head zone map displays each of the plurality of zones; and comparing a location at which the microphone assembly is located on the head of the recipient to the head zone map overlayed on the head of the recipient.

19. The method of claim 18, wherein overlaying a head zone map on the head of the recipient comprises:

overlaying, on the head of the recipient, a head zone map formed from at least one of a sheet of paper, a sheet of plastic, or a sheet of silicone.

20. The method of claim 18, wherein overlaying the head zone map on the head of the recipient, comprising:

projecting an image including a head zone map onto the head of the recipient.

* * * * *